United States Patent [19]

Bales et al.

[11] Patent Number: 4,527,542

[45] Date of Patent: Jul. 9, 1985

[54] OVEN VENTILATING SYSTEM

[75] Inventors: Michael E. Bales, New Palestine; Wallace E. Schmidt, Carmel, both of Ind.

[73] Assignee: The Maytag Company, Newton, Iowa

[21] Appl. No.: 621,946

[22] Filed: Jun. 18, 1984

[51] Int. Cl.[3] ..... F24C 15/20

[52] U.S. Cl. ..... 126/299 D; 126/299 R; 126/300; 126/21 R

[58] Field of Search ..... 126/299 R, 299 D, 301, 126/302, 303, 21 R, 307 R, 312; 99/340; 55/DIG. 36; 98/36, 41

[56] References Cited

U.S. PATENT DOCUMENTS

| | | | |
|---|---|---|---|
| 2,081,640 | 5/1937 | Petersen | 126/299 D |
| 2,586,023 | 2/1952 | Gillette | 126/299 R |
| 2,595,480 | 5/1952 | Nelson et al. | 125/299 |
| 2,634,718 | 4/1953 | Williams | 126/299 R |
| 3,384,067 | 5/1968 | Rawald et al. | 126/21 |
| 3,756,217 | 9/1973 | Field | 126/301 |
| 3,924,601 | 12/1975 | Nuss | 126/21 R |
| 4,428,357 | 1/1984 | Field | 126/299 R |

FOREIGN PATENT DOCUMENTS

| | | | |
|---|---|---|---|
| 2086034 | 5/1982 | United Kingdom | 126/303 |

*Primary Examiner*—James C. Yeung
*Attorney, Agent, or Firm*—Richard L. Ward

[57] ABSTRACT

An oven ventilating system is provided for use in conjunction with a proximity ventilated range having modular plug-in cooktop cartridges. A vent tube extends upwardly from an oven vent outlet to a position adjacent the air intake grill. The venting path, in one embodiment, is completed by a collar-like chimney portion of the air intake grill which cooperates with the top of the vent tube to conduct exhaust fumes to above the top surface of the range.

11 Claims, 5 Drawing Figures

OVEN VENTILATING SYSTEM

BACKGROUND OF THE INVENTION

This invention relates generally to the field of domestic stoves or ranges and more particularly to providing an improved oven ventilating system for a range having proximity ventilation for normally exhausting cooking fumes from the top surface or cooktop.

Generally, the state of the oven venting art in ranges without proximity ventilation is to simply vent the oven to the kitchen through one of the surface cooking elements. However, a range which utilizes interchangeable modular plug-in surface elements cannot normally vent in this fashion. The present invention provides for venting the exhause fumes including heat, smoke, and odors associated with either baking or a self-cleaning cycle to the general vicinity of the proximity ventilation air intake for facilitating the conveyance of these exhaust fumes to a remote location such as out of doors.

The prior art has included venting an oven directly to a substantially closed collection box and then out doors such as in U.S. Pat. No. 2,595,480 issued to Nelson et al on May 6, 1952. Nelson et al teach a self-ventilating range structure including a blower unit mounted in a compartment below the oven. The rear of the range includes a collector box with an air intake spaced substantially above the top surface of the range. The collector box is rectangular in shape, covers the back of the range and is an extension of the back splash. The central portion of the bottom of the collector box tapers into a conduit which leads to the blower intake. The rear of the oven includes a vent opening which is in direct communication with the collector box for venting exhaust fumes thereinto.

In U.S. Pat. No. 3,384,067 issued to Rawald et al on May 21, 1968, there is shown a self-cleaning, wall mounted oven arrangement. In this oven arrangement, the oven cavity is suspended within an outer shell so that cooling air can flow freely around all of the oven walls. A blower is located in the top wall of the outer shell and when the blower is operated cooling air is drawn around the oven walls. Exhaust air is pulled from the oven through slots adjacent the top front door area and mixed with the cooling air in the substantially closed intermediate chamber.

In a self-ventilated range such as disclosed in Nelson et al, the oven is directly vented into a plenum or collection box associated with the blower intake. This oven venting arrangement necessitates that the blower be non-operational during baking since heated air will be pulled directly from the oven cavity. This direct evacuation of heated air would cause cycling of the oven thermostats and the oven baking performance would be uneven.

The prior art relating to venting an oven thus includes simple venting into the kitchen environment through a surface cooking element. Also, a system has been shown in which the oven is vented directly into the generally closed collector box of a blower apparatus and the vapors are then exhausted out of doors. Still another system describes oven cooling apparatus in which cooling air is drawn around the oven chamber and oven exhaust fumes are mixed with the cooling air and then directed out of doors. Until the present invention, there has been no known showing of an oven venting arrangement combined with a proximity ventilating system in which oven exhaust fumes are conducted to the kitchen environment in the general vicinity of the range top near the air inlet of the proximity ventilation system. The oven exhaust fumes are captured by the proximity ventilating system when operating or are vented to the kitchen environment if not operating with performance of the oven being consistent and independent of the proximity ventilating system.

SUMMARY OF THE INVENTION

It is therefore an object of the instant invention to provide an improved oven exhaust ventilating system.

It is a further object of the instant invention to provide an oven exhaust venting path to the top surface of a range having interchangeable plug-in cooking cartridges.

It is a still further object of the instant invention to provide an oven ventilating system where the range operator may select operation of a proximity ventilating system without altering the baking characteristics of the oven.

Briefly, the instant invention achieves these objects in a venting system for a range including an oven and having a proximity ventilation air intake in association with the top surface of the range. A plenum communicates with the air intake and a duct is provided for conducting fumes to atmosphere outside of the kitchen environment of the range. A proximity ventilation blower is in communication with the plenum and the duct and is operable for exhausting cooking fumes from the environment adjacent the top surface through the air intake, the plenum and the duct to atmosphere. An oven exhaust vent includes an inlet in airflow communication with the oven for receiving oven exhaust fumes and further includes an outlet cooperatively adjacent the proximity ventilation air intake. The oven exhaust vent conducts exhaust fumes from the oven to the environment adjacent the top surface for transfer to the air intake under the urging of the blower for exhausting to atmosphere.

Operation of the oven ventilating system and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
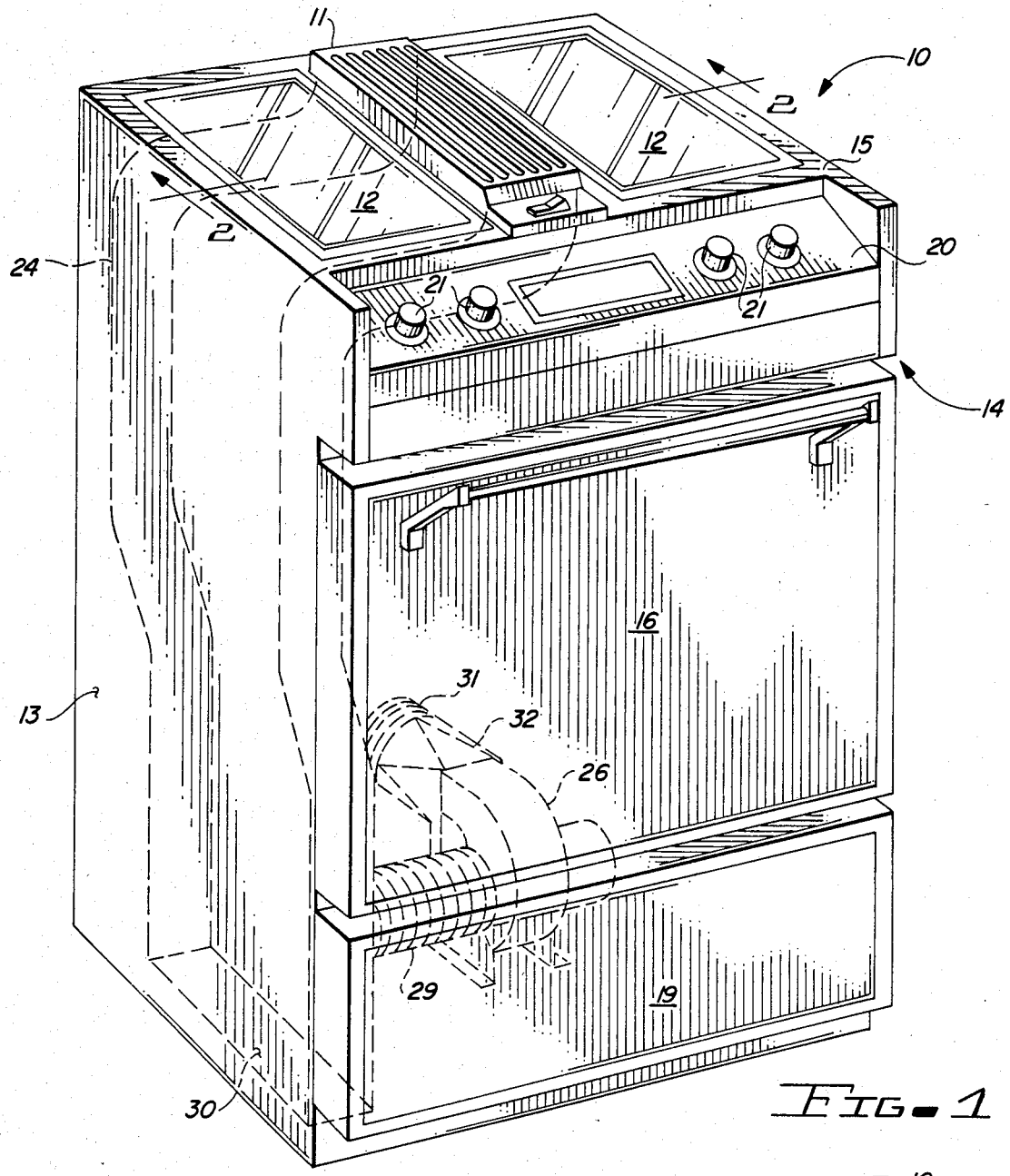
FIG. 1 is a pictorial view of a proximity ventilated range employing the present invention.

Referring now to the drawings and in particular to FIG. 1, there is shown a free-standing range or stove 10 of the type incorporating proximity ventilation and having a centrally located air intake 11. The range 10 of FIG. 1 utilizes interchangeable plug-in modular cooktop cartridges 12. These interchangeable cooktop cartridges 12 are generally illustrated in FIG. 1 as comprising smooth cooktop units but can also include a variety of cooking accessories as well as conventional heating elements.

The range 10 as shown in FIG. 1 includes a generally rectangular cabinet structure having substantially vertically disposed side and front panels 13 and 14 and a generally horizontally disposed top surface 15. The cabinet portion generally designated as front panel 14 is comprised of a forwardly opening oven door 16 and a forwardly opening access door 19 which is disposed directly beneath the oven door 16. A control panel 20 is also generally associated with the front panel 14 and includes a plurality of control knobs 21 for controlling individual operation of the cooktop cartridges 12 and the oven 22.

Figure 2:
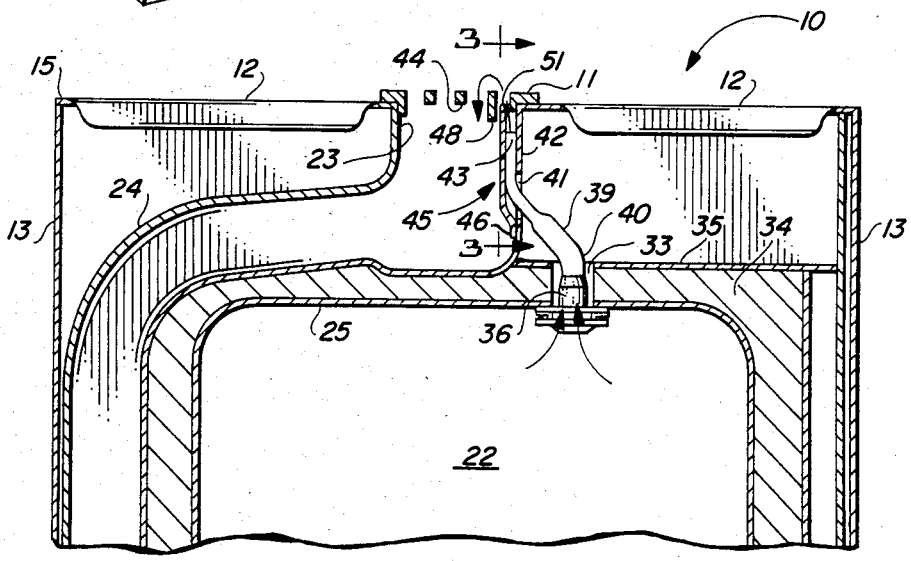
FIG. 2 is a partial vertical section view taken generally along lines 2—2 of the proximity ventilated range of FIG. 1 and showing the oven venting system of the present invention.

As best shown in dashed lines in FIG. 1 and in the section view of FIG. 2, the free-standing range 10 includes a proximity ventilating system for removing cooking vapors from the vicinity of the cooking cartridges 12 and exhausting them to a remote location such as out of doors. The proximity ventilation system includes an air inlet grill 11 which overlies a plenum opening 23 in the top surface of the range. This air intake grill 11 and the plenum opening 23 are generally centered on the width of the top surface 15 and extend substantially the full front-to-rear depth of the top surface 15 of the range 10.

As further shown by the dashed lines of FIG. 1 and in FIG. 2, an exhaust plenum 24 extends from the plenum opening 23 downward to the top 25 of the oven 22 and generally horizontally toward the left side of the cabinet when viewed from the front of the range 10. The exhaust plenum 24 continues downwardly along the left side of the oven 22 and into the access area serviced by the access door 19. As further shown in FIG. 1, a blower 26 is located within the access area and an intake conduit 29 is connected to the lower end 30 of the exhaust plenum 24. As exhaust conduit 31 is attached to the blower exhaust end 32 and is directed away from the range.

Figure 3:
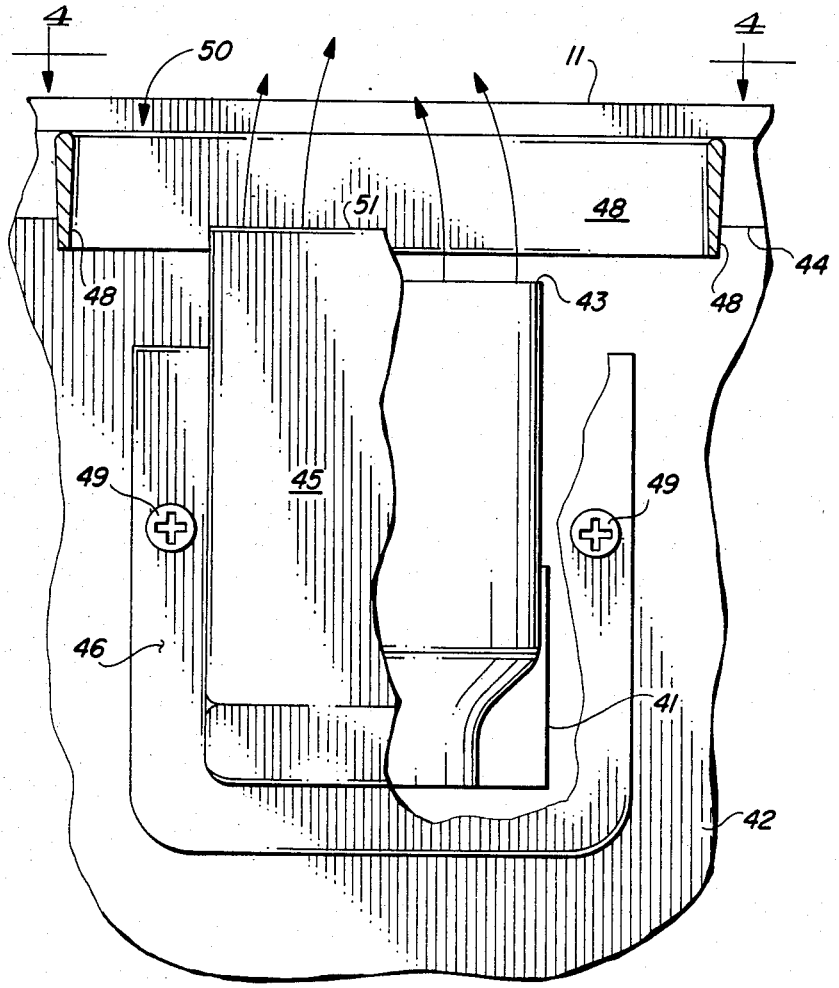
FIG. 3 is a fragmentary section view taken generally along lines 3—3 of FIG. 2.
Figure 4:
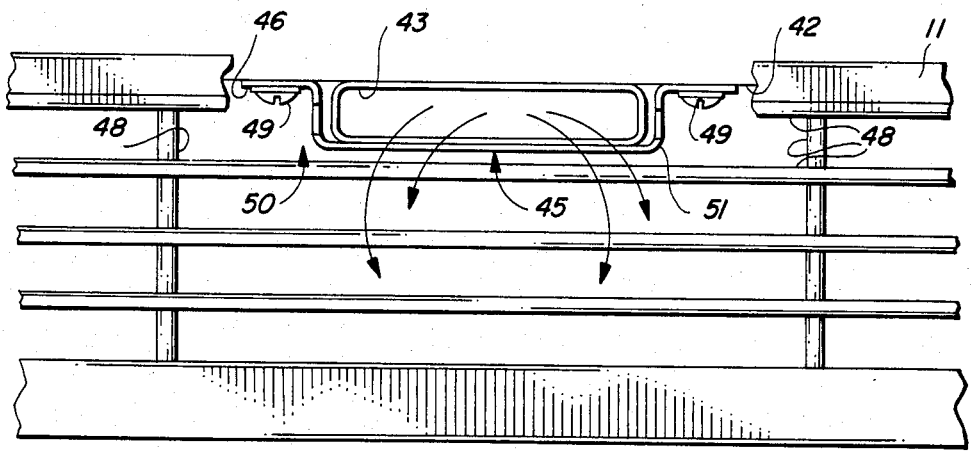
FIG. 4 is another fragmentary view taken generally along lines 4–4 of FIG. 3.

Turning now to FIGS. 2–4, there is shown an oven ventilating system for use with the free-standing range 10 of FIG. 1. In this embodiment of the invention, there is shown an aperture 33 in the top wall 25 of the oven 22. This aperture 33 extends through the insulation shell 34 and the outer wall 35 of the oven 22. In the case of a self-cleaning oven, a smoke eliminator element 36 is attached to the top 25 of the oven 22 and extends into the aperture 33. If the oven 22 is not self-cleaning, the smoke eliminator element 36 is replaced by an appropriate outlet plate.

As best shown in FIG. 2, a vent tube 39 extends upwardly from the smoke eliminator 36. The lower portion or inlet end 40 of the vent tube 39 is generally circular in configuration and communicates with a similar circular segment of the smoke eliminator 36. The vent tube 39 angles to the left as it extends upwardly and protrudes through a generally rectangular opening 41 in a substantially vertical side wall 42 of the exhaust plenum 24 as is best shown in FIGS. 2 and 3. As the vent tube 39 extends through the rectangular opening 41, the circular configuration transitions into a generally rectangular shape at the outlet end 43 as shown in FIGS. 3 and 4. The generally rectangular outlet end 43 of the vent tube 39 continues upwardly parallel with the side wall 42 of the exhaust plenum 24 and terminates in a posture which is in spaced juxtaposition to the bottom 44 of the air inlet grill 11 as illustrated in FIGS. 2 and 3.

A vent tube cover 45 is shown in FIGS. 2–4 and is utilized for effectively capturing the rectangular outlet end 43 of the vent tube 39 relative to the side wall 42 of the exhaust plenum 24. The vent tube cover 45 is generally rectangular and includes a flange 46 extending around the bottom and sides. The flanged sides are apertured to receive a pair of sheet metal fasteners 49 for securing the vent tube cover 45 to the side wall 42. The vent tube cover 45 is formed so that it overlies the rectangular opening 41 in the side wall 42 and effectively seals the side wall 42 to prevent the proximity ventilation system from drawing air through the rectangular opening 41 and directly into the exhaust plenum 24.

FIGS. 2 and 3 further show the outlet end 43 of the vent tube 39 terminating in spaced juxtaposition to the bottom of the air inlet grill 11. The peripheral walls 48 of one of the rectangular openings in the air inlet grill 11 extend downward below the bottom 44 of the air inlet grill 11 and surround the outlet 51 of the vent tube cover 45 which is spaced slightly above the level of the outlet end 43 of the vent tube 39. The downwardly extending peripheral walls 48 thus form a collar-like member surrounding the outlet 51 of the vent tube cover 45 with the combination of elements 45 and 48 defining a chimney 50 for conducting exhaust fumes from the outlet end 43 of the vent tube 39 to above the top surface 15 of the range 10.

Once the exhaust fumes have been conducted to above the top surface 15 of the range 10 they will be subjected to the action of the proximity ventilation system, if operating, and will be mixed with fumes drawn from the vicinity of the cooking cartridges 12. If the oven 22 is in a self-cleaning mode, various products of the cleaning process are exhausted through the vent tube 39 and subsequently to atmosphere through the proximity ventilation system. Operation of the proximity ventilation system in a baking operation or in the self-cleaning mode is totally optional on the part of the operator. In the self-cleaning mode, the operator may prefer to simply vent the cleaning fumes to the kitchen environment if the soil in the oven 22 is light. However, if the soil in the oven 22 is heavy, the operator will generally prefer to vent the greater quantity of fumes generated out of doors through the proximity ventilation system. During baking there is generally no need to vent the oven 22 away from the range 10 but the operator has the option of operating the proximity ventilation system to vent out of doors without adversely effecting baking results. The oven ventilating system of the instant invention provides for uniform baking results independent of the proximity ventilation system by isolating the outlet end 43 of the vent tube 39 from the plenum 24 causing the exhaust fumes to be conducted to atmosphere at the top surface of the range before being captured by the proximity ventilation system if operating.

Figure 5:
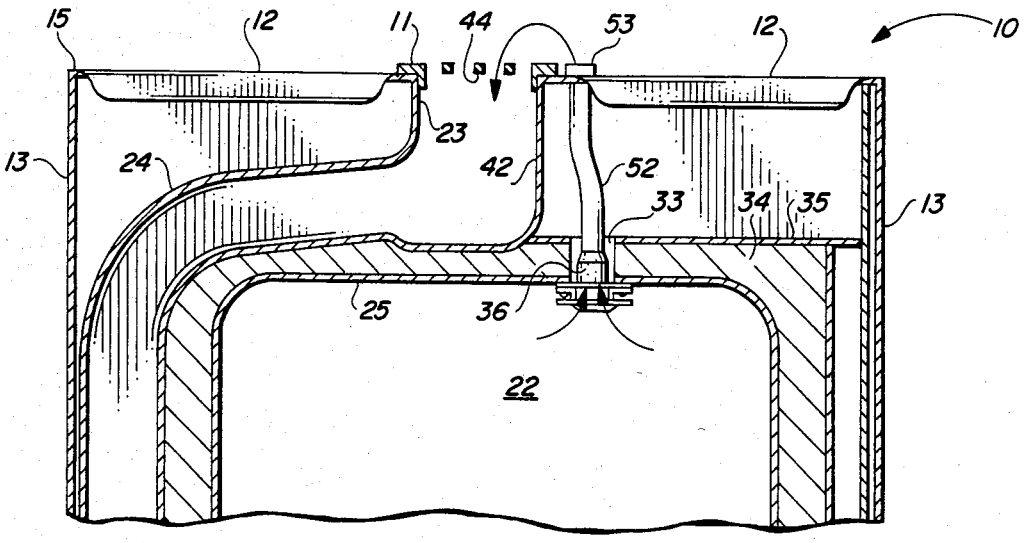
FIG. 5 is a partial vertical section view similar to FIG. 2 and showing an alternate embodiment of the venting arrangement.

FIG. 5 represents an alternate embodiment of the oven ventilating system. In FIG. 5, a vent tube 52 extends upwardly from the smoke eliminator 36 to a vent opening 53 in the top surface 15 of the range 10 between the air inlet grill and one of the plug-in modular cooktop cartridges 12. This embodiment provides a straight-line exhaust path to the top surface 15 of the range 10 without passing through the side wall 42 of the exhaust plenum 24.

During operation of the free-standing range 10 of FIG. 1, the excess heat and vapors given off by the oven 22 during normal baking are naturally vented through the smoke eliminator 36, through the vent tube 39 and through the collar-like chimney 50 in the air intake grill 11 to a location adjacent to or slightly above the top surface 15 of the range 10. It is noted that the combination of the chimney 50 and the outlet 51 of the vent tube cover 45 prevents the proximity ventilating system from pulling exhaust vapors directly into the exhaust stream as would be the case if the oven 22 were simply vented into the exhaust plenum 24. The vapors are vented adjacent to or slightly above the top surface 15 of the range 10 and then they are mixed with air and other cooking vapors from the cooktop cartridges 12 prior to exhausting to atmosphere if the proximity ventilating system is in operation. With the oven vent tube 39 isolated in this manner by the chimney 50, the calibration of the oven thermostat and baking characteristics are not significantly changed by either operation or non-operation of the blower 26 associated with the proximity ventilation system. During a self-cleaning cycle the odors, smoke and heat produced by that cycle are captured and exhausted out of doors if desired by the operator.

There has thus been provided an improved oven ventilating system for a range which has proximity ventilation of plug-in modular cooktop cartridges. In one embodiment of this oven ventilating system, the oven vent provides an airflow path for conducting fumes from the oven upward to just below the bottom of the air intake grill of the proximity ventilating system. At the outlet end of the vent tube, a chimney structure formed by a portion of the air intake grill and the top of the vent tube cover conducts the exhaust fumes above or adjacent to the top surface of the range so that these fumes may be mixed with the airflow into the air inlet grill and then exhausted to atmosphere. The system provides for venting of the oven adjacent the air intake grill of a proximity ventilating system without changing calibration of the oven thermostat or effecting baking characteristics of the oven if the proximity ventilating system is operating.

In the drawings and specification there is set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as further defined in the following claims.

We claim:

1. A venting system for a range including surface heating units, self-contained proximity ventilation apparatus and an oven, comprising: proximity ventilation air intake means in the top surface of said range adjacent said heating units; plenum means within said range and communicating with said air intake means; duct means for conducting fumes to atmosphere outside of the kitchen environment of said range; proximity ventilation blower means within said range communicating with said plenum means and said duct means and operable for exhausting cooking fumes from the environment adjacent said top surface through said air intake means, said plenum means and said duct means to said atmosphere; oven exhaust vent means within said range and having an inlet in airflow communication with said oven for receiving oven exhaust fumes, said vent means including an outlet in the top surface of said range and in close juxtaposition to said proximity ventilation air intake means, said vent means conducting exhaust fumes from said oven to the environment adjacent said top surface for transfer to said air intake means under the urging of said blower means for exhausting to said atmosphere.

2. A venting system as defined in claim 1 wherein said proximity ventilation blower means is selectively operable for enabling said oven to be optionally vented to said kitchen environment or to said atmosphere remote from the kitchen.

3. A venting system as defined in claim 1 wherein said oven exhaust vent means includes a portion extending through said plenum means to dispose said outlet in association with said air intake means.

4. A venting system as defined in claim 3 wherein said air intake means includes a grill member having a first grill portion defining an intake to said plenum means and a second grill portion through which oven exhaust fumes are exhausted from said oven exhaust vent means outlet.

5. A venting system as defined in claim 4 wherein said second grill portion includes a collar extending downwardly and in close proximity to the outlet end of said oven exhaust vent means to define a chimney for conducting oven exhaust fumes to said environment at the top surface of said range.

6. A venting system for a range including surface heating units and an oven, comprising: self-contained proximity ventilation means including air intake grill means in the top surface of said range adjacent said heating units; plenum means within said range and communicating with a first portion of said air intake grill means; duct means for conducting cooking fumes to atmosphere outside of the kitchen environment of said range; proximity ventilation blower means within said range communicating with said plenum means and said duct means and operable for exhausting cooking fumes from the environment adjacent said top surface through said grill means first portion, said plenum means and said duct means to said atmosphere; oven exhaust vent means within said range and having an inlet in airflow communication with said oven for receiving oven exhaust fumes, said vent means including an outlet disposed for exhausting said exhaust fumes to the environment adjacent said top surface through a second portion of said air intake grill means for transfer to said first portion of said air intake grill of said proximity ventilation means under the urging of said blower means for exhausting to said atmosphere.

7. A venting system for an oven range as defined in claim 6 wherein said grill means second portion includes collar means defining a chimney adjacent said outlet to conduct exhaust fumes to the environment at the top surface of said range.

8. A venting system as defined in claim 6 wherein said proximity ventilation means is selectively operable for enabling said oven to be optionally vented to said kitchen environment or to said atmosphere remote from the kitchen.

9. A venting system for a range including surface heating units and an oven, comprising: self-contained proximity ventilation means including air intake means in the top surface of said range adjacent said heating units; plenum means within said range and communicating with said air intake means; duct means for conducting fumes to atmosphere outside of the kitchen environment of said range; proximity ventilation blower means within said range communicating with said plenum means and said duct means and operable for exhausting cooking fumes from the environment adjacent said top surface through said air intake means, said plenum means and said duct means to said atmosphere; oven exhaust vent means within said range and having an inlet in airflow communication with said oven for receiving oven exhaust fumes, said vent means including a portion within said plenum means and terminating with an outlet disposed generally subjacent said proximity ventilation air intake means; and means including a cover generally surrounding that portion of said vent means within said plenum means for forming a chimney from said outlet through said air intake means to duct said oven exhaust fumes to the environment adjacent said top surface for transfer to said air intake means under the urging of said blower means for exhausting said oven exhaust fumes to said atmosphere.

10. A venting system for an oven range as defined in claim 9 wherein said ventilation air intake means includes a grill member having a first portion with a plurality of apertures defining an air intake to said plenum means and further having a second portion including a single aperture having peripheral walls extending downwardly below the generally horizontal plane of the underside of the air intake means to form said chimney for ducting said oven exhaust fumes from said outlet to the environment adjacent said top surface.

11. A venting system for a range including surface heating units and an oven, comprising: self-contained proximity ventilation means including air intake grill means in the top surface of said range adjacent said heating units, said air inlet grill means having a first portion with a plurality of apertures defining exhaust inlet means from adjacent said top surface and a second portion comprising an oven exhaust chimney; plenum means within said range and communicating with said first portion of said air intake grill means; duct means for conducting cooking fumes to atmosphere outside of the kitchen environment of said range; proximity ventilation blower means within said range communicating with said plenum means and said duct means and operable for exhausting cooking fumes from the environment adjacent said top surface through said grill means first portion, said plenum means and said duct means to said atmosphere; oven exhaust vent means having an inlet in airflow communication with said oven for receiving oven exhaust fumes, said vent means including an outlet generally aligned with and subjacent said oven exhaust chimney; and cover means surrounding at least the outlet of said vent means and including a portion extending from said outlet to within said exhaust chimney for completing a substantially closed exhaust path to conduct exhaust fumes from said oven to the environment adjacent said top surface for transfer to said proximity ventilation means under the urging of said blower means for exhausting to said atmosphere.

* * * * *